US005980141A

United States Patent [19]

Donnis

[11] Patent Number: 5,980,141

[45] Date of Patent: Nov. 9, 1999

[54] INK JET PRINTER FOR DELAYING THE STACKING OF THE PRINTED SHEETS AND ASSOCIATED METHOD OF OPERATION

[75] Inventor: Gian Paolo Donnis, Vercellese, Israel

[73] Assignee: Olivetti Lexikon S.p.A., Ivrea, Italy

[21] Appl. No.: 09/061,191

[22] Filed: Apr. 17, 1998

[30] Foreign Application Priority Data

Apr. 21, 1997 [IL] Israel ..... T097A/0337

[51] Int. Cl.[6] ..... B65H 7/00

[52] U.S. Cl. ..... 400/625; 347/104; 271/266

[58] Field of Search ..... 347/16, 102, 101, 347/104; 400/624, 625, 627, 628, 629; 101/424.1; 271/202, 265.01, 266, 270

[56] References Cited

U.S. PATENT DOCUMENTS 4,566,014 1/1986 Paranjpe et al. ..... 346/1.1

FOREIGN PATENT DOCUMENTS

0768187 A2 4/1997 European Pat. Off. .
63-309056 12/1988 Japan .
1-249457 10/1989 Japan .
3-261576 11/1991 Japan .
4-89756 3/1992 Japan .
2301342A 12/1996 United Kingdom .

OTHER PUBLICATIONS

Patent Abstracts of Japan, vol. 095, No. 011, Dec. 26, 1995, JP 07 205416A (Canon Inc.).
Patent Abstracts of Japan, vol. 014, No. 570 (M–1060), Dec. 18, 1990, JP 02 245356 A (Canon Inc.).

*Primary Examiner*—Edgar Burr
*Assistant Examiner*—Daniel J. Colilla
*Attorney, Agent, or Firm*—Banner & Witcoff, Ltd.

[57] ABSTRACT

The printer (10) has an ink jet printhead (12) suitable for printing single sheets (14) and a control device (40) adapted to delay expulsion of the same to a collection tray (16), with the purpose of extending the drying time of the ink ejected by the printhead (12) on each sheet, before a following sheet is stacked thereon. The device (40) is suitable for controlling means (17, 25) for feeding of the sheets (14) through the printer (10) so as to temporarily stop the feeding of a first sheet (14*a*) after it has been printed on, then to feed a second sheet (14*b*) until it comes to a predetermined minimum distance (D) from the first sheet (14*a*), and finally to simultaneously feed the first sheet (14*a*) and the second sheet (14*b*), so as to expel the first sheet (14*a*) to the collection tray (16) and to further feed the second sheet (14*b*) so that it can be printed on. The device (40) preferably comprises a group consisting of a threaded element (61) and a toothed element (62), which are adapted to couple and uncouple by torsional means, rotating with respect to one another, so that pairs of sheet expulsion rollers (42*a*,42*b*) are disconnected from a sheet feeding roller (27), during a predetermined relative rotation of the two elements (61,62).

17 Claims, 4 Drawing Sheets

INK JET PRINTER FOR DELAYING THE STACKING OF THE PRINTED SHEETS AND ASSOCIATED METHOD OF OPERATION

FIELD OF THE INVENTION

This invention relates generally to a printer for single sheets provided with an ink jet printhead and means intended for delaying the stacking of the last sheet printed by the printer on the one printed previously, in order to avoid the stacking from impairing the quality of the characters and/or symbols printed on the sheets because the ink ejected by the ink jet printhead thereon has not dried completely.

BACKGROUND OF THE INVENTION

Various solutions are known for producing in an ink jet printer the means described in summary form above, which generally adhere to the concept of keeping the last sheet distinctly separate from the previous one while it is being printed, so that the last sheet is stacked on the previous one only after it has been printed on, or with a delay determined by the amount of ink ejected.

One solution is, for example, described in the U.S. Pat. No. 4,844,633, where arrangement is made for a pair of rotatable tabs suitable for accompanying a sheet as it is fed during printing, in such a way as to support it constantly by its central portion. On completion of printing, the tabs move away from the sheet, so that the latter falls vertically on a previously printed sheet underneath.

This solution implies an accumulation of the printed sheets according to a horizontal or almost horizontal arrangement, since only in this way can the sheets fall vertically and be stacked correctly on top of each other. Accordingly this solution is difficult to apply where it is desired to have the sheets accumulated according to a different arrangement following printing, for example so that they assume an almost vertical arrangement thus enabling a considerable reduction in overall plan dimensions of the printer.

The solution envisaged by U.S. Pat. No. 4,728,963 also has the application limits outlined above.

SUMMARY OF THE INVENTION

The technical problem that this invention intends to solve is that of finding a better performing solution, and one which in particular extends the application possibilities as offered by the currently known solutions which have been devised to prevent two sheets printed one after the other in an ink jet printer, from being stacked on top of each other before the ink has dried fully.

This problem is solved by the solution adopted for the printer according to this invention and having the characteristics listed in the main claim.

The present invention also relates to a method of operation of an ink jet printer for single sheets, intended to avoid the printed sheets being stacked one on top of the other before the ink ejected thereon has dried fully.

BRIEF DESCRIPTION OF THE DRAWINGS

A clearer understanding of these and other characteristics of the invention will be gained from the following description, provided purely by way of an illustrative, non-restrictive example, with reference to the accompanying drawings, where.

DESCRIPTION OF A PREFERRED EMBODIMENT OF THE INVENTION

Figure 1:
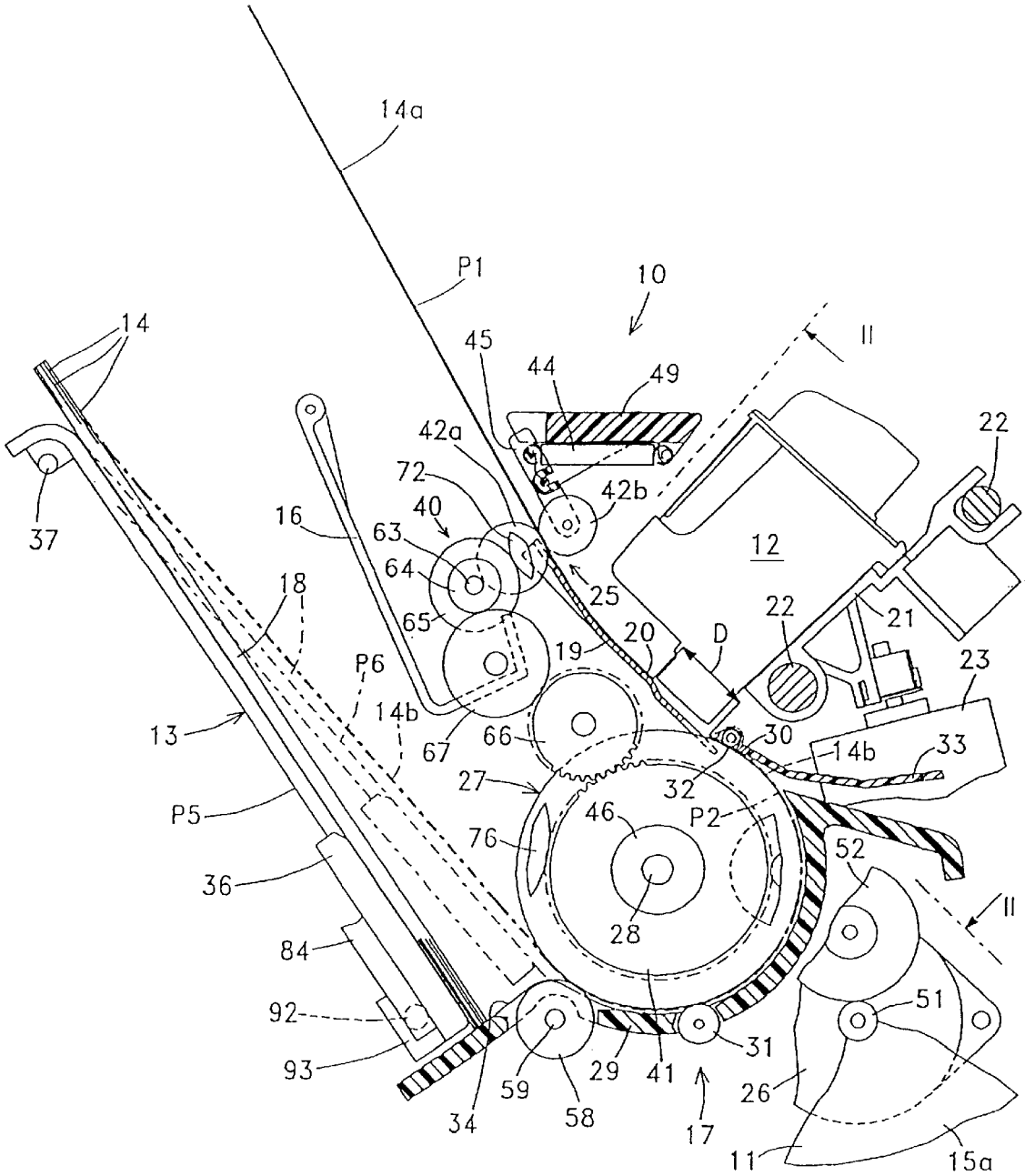
FIG. 1 is a simplified, sectional view in vertical elevation of an ink jet printer according to this invention.

With reference to FIG. 1, a printer according to the invention is generically indicated with the numeral 10 and comprises a fixed structure 11 on which the various mechanisms of the printer 10 are fitted and which is depicted by way of example through a portion of a side 15*a* of the structure 11 itself, a feeding tray 13 adapted to contain a plurality of sheets 14 arranged one on top of the other so as to form a ream 18, a print group having an ink jet printhead 12, an expulsion group 26 adapted to expel the sheets 14 after they have been printed on by the printhead 12, a feeding mechanism, generically indicated with the numeral 17, suitable for feeding the sheets 14 from the feeding tray 13 to the expulsion group 25, passing them in front of the head 12 to be printed on, and a collection tray 16 adapted to receive the sheets 14 from the expulsion group 25.

The ink jet printhead 12 is removably mounted on a carriage 21 sliding on ways 22 affixed to the structure 11 and is arranged to be driven and moved transversally by a motor 23 in relation to the feeding direction of the sheets 14 and print thereon symbols and/or characters by ejecting droplets of ink, in ways known in the sector art. A support plate 19 is adapted to support the sheets 14 as they are printed by the head 12 and convey them from the latter to the expulsion group 25.

Figure 2:
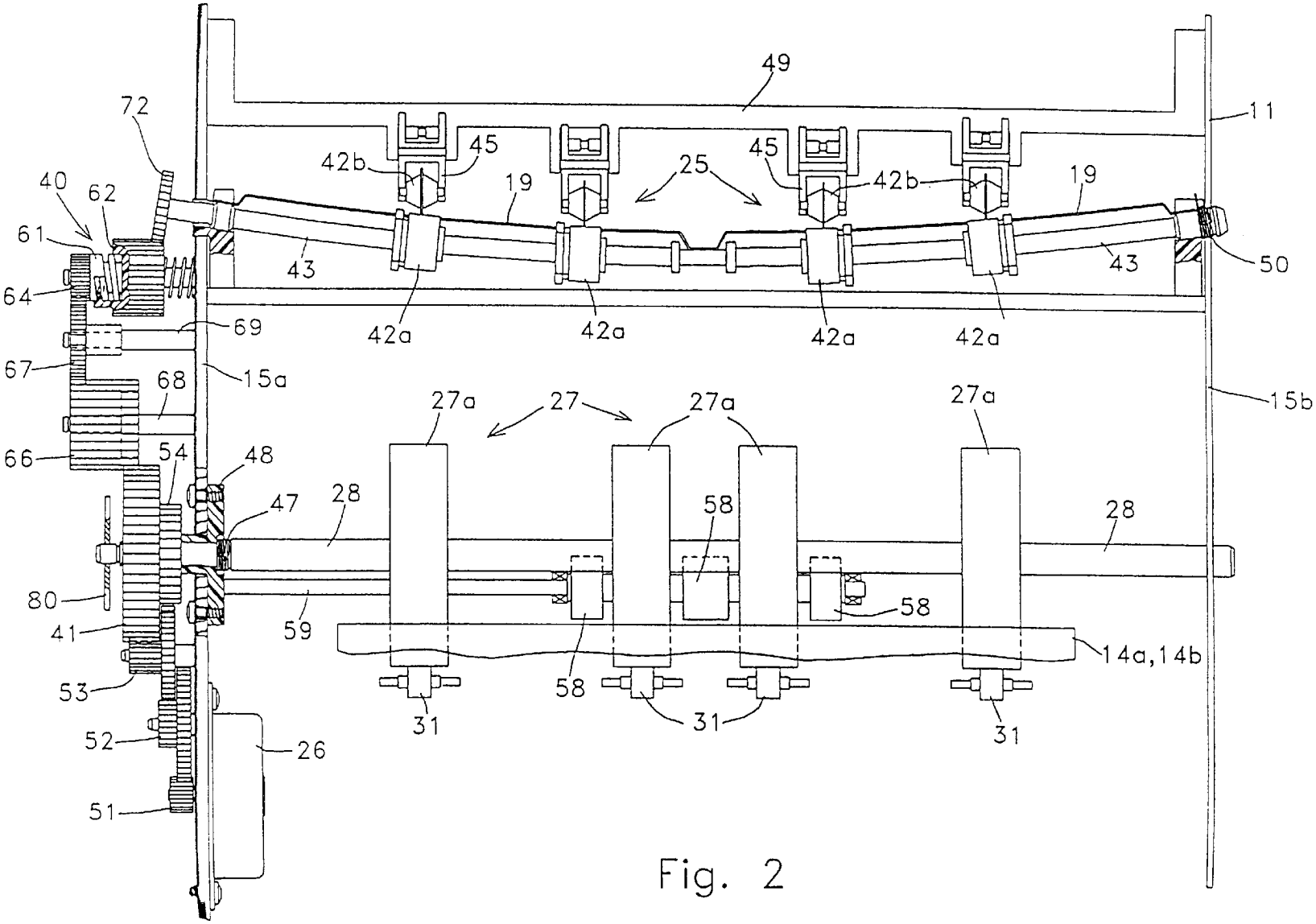
FIG. 2 is a simplified front view of the printer of FIG. 1, drawn for clarity along the line II—II indicated thereon.

The feeding mechanism 17 is driven by a single main motor 26 through a kinematic linkage, described below in greater detail, and comprises a main feeding roller 27, consisting of a plurality of feeding elements 27*a* (for example 4, as shown in FIG. 2), which are attached to a shaft 28 rotating on the side 15*a* and on another side 15*b* of the fixed structure 11.

The feeding roller 27 is disposed between the feeding tray 13 and the head 12 in order to convey to the latter, one at a time, the sheets 14 of the ream 18 deposited in the feeding tray 13. For this purpose the main feeding roller 27 is suitable to cooperate with a conveyor profile 29, integral with the structure 11, which partially surrounds the element 27*a*, and with a series of freely rotating pressure wheels, each of which is pressed against a corresponding feeding element 27*a*. The pressure wheels are divided into a series of lower pressure wheels 31 rotating about the profile 29 and arranged adjacent to the feeding tray 13, and a series of upper pressure wheels 32, rotating about a profile 33, being of smaller diameter than the wheels 31, and arranged adjacent to the printhead 12.

Figure 5:
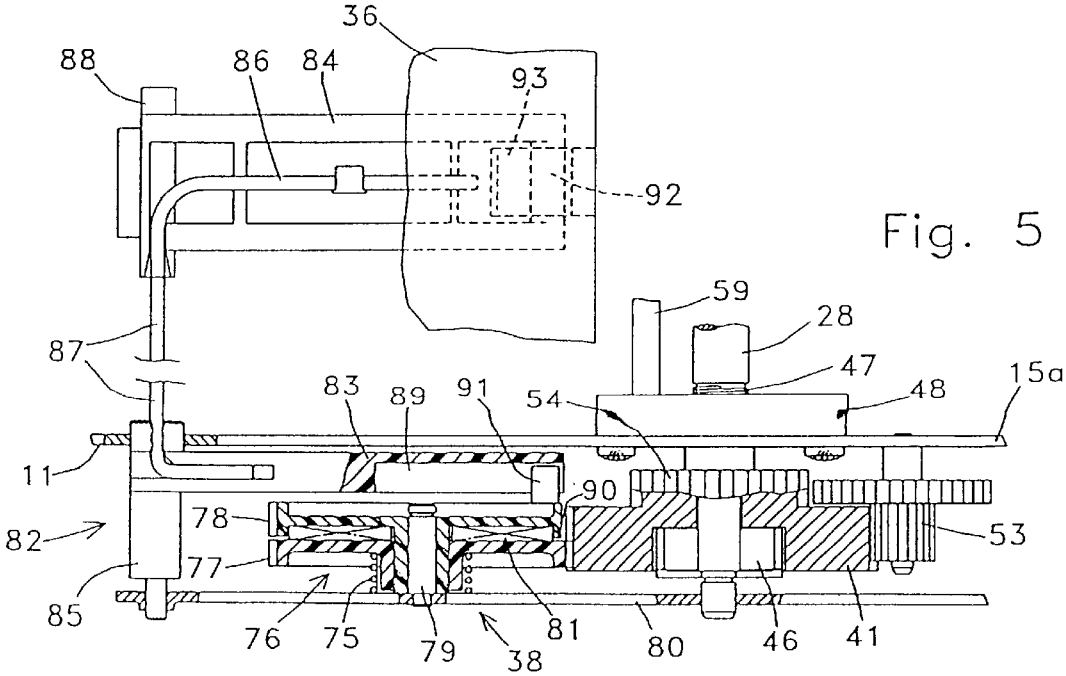
FIG. 5 is a view from above of the mechanism of FIG. 4.

The feeding tray 13 comprises a bottom wall 34, built as a single piece with the conveyor profile 29 and suitable for acting as an abutment for the sheets 14, and a movable wall 36 fulcrum-mounted on a pin 37. The movable wall 36 is adapted to be selectively rotated about the pin 37 in order to approach or draw away from the feeding mechanism 27, by means of a drive mechanism 38 (FIG. 5), suitable for receiving motion from the main motor 26, which will be described in detail later.

The shaft 28 is rotationally coupled at one end, by means of a monodirectional coupling 46, with a main feeding gear 41, which is suitable for receiving motion from the motor 26 through a gear train, and is in turn, through another gear train, suitable for driving the expulsion group 25.

The latter comprises a series of pairs of expulsion rollers 42*a*, 42*b* (for example, 4 pairs, as depicted in FIG. 2) arranged above the printhead 12 for receiving, between the rollers 42*a*, 42*b*, the sheets 14 coming from the latter along the support plate 19, after they have been printed on. In addition, the pairs of expulsion rollers 42*a*, 42*b*, on the side opposite the printhead 12, face onto the collection tray 16, bringing and expelling to the latter the sheets 14 thus received.

More specifically, the rollers 42*a* are affixed to a flexible shaft 43 rotating about the fixed structure 11 and are adapted to be driven by the rotation of the flexible shaft 43 so that each brings a corresponding roller 42*b* into rotation, whereas the rollers 42*b* are free to rotate about arms 45, one for each pair, and fulcrum-mounted on a cross-piece 49 integral with the fixed structure 11. The rollers 42*a*, 42*b* of each pair are pressed one against the other by a traction spring 44 (FIG. 1), attached at one end to the cross-piece 49 and at the other end to the corresponding arm 45.

The flexible shaft 43 is fitted on the sides 15*a* and 15*b* of the structure 11 in such a way as to assume a curved configuration, as depicted in FIG. 2, so that the pairs of rollers 42*a*, 42*b* are also conformingly arranged. In particular, the two pairs of rollers 42*a*, 42*b*, arranged adjacent to the sides 15*a* and 15*b*, are in a raised position with respect to the two pairs 42*a*, 42*b* arranged in the central area of the printer 10. Arranged accordingly, the pairs of expulsion rollers 42*a*, 42*b* acquire the ability to arch and stiffen the sheets 14 as they feed them before expelling them to the collection tray 16, so that the sheets 14 do not fold and are kept straight, in order to be stacked correctly one on top of the other in the collection tray 16. Furthermore, a reverse gear 50, of known type and consisting of a helical spring, is attached to the side 15*b* in coincidence with one end of the flexible shaft 43, to prevent the latter from rotating backwards, namely in the opposite direction to that of expulsion of the sheets 14 to the collection tray 16.

The monodirectional coupling 46 is arranged between the shaft 28 and the main gear 41, with the purpose of torsion coupling them only when the main gearing 41 rotates according to a predefined direction of rotation, in particular the counter-clockwise direction for feeding the sheets 14, as depicted in FIG. 1. In order to prevent the shaft 28 and accordingly also the main feeding roller 27 integral therewith from being turned by friction, even if only for a short stretch, by the main gear 41, when the latter rotates counter-clockwise during certain stages of operation described later, a reverse gear element 47 (FIG. 2) is further provided and is arranged between a flange 48 attached to the fixed structure 11 and the shaft 28 to prevent any rotation whatsoever of the latter apart from counter-clockwise.

Figure 4:
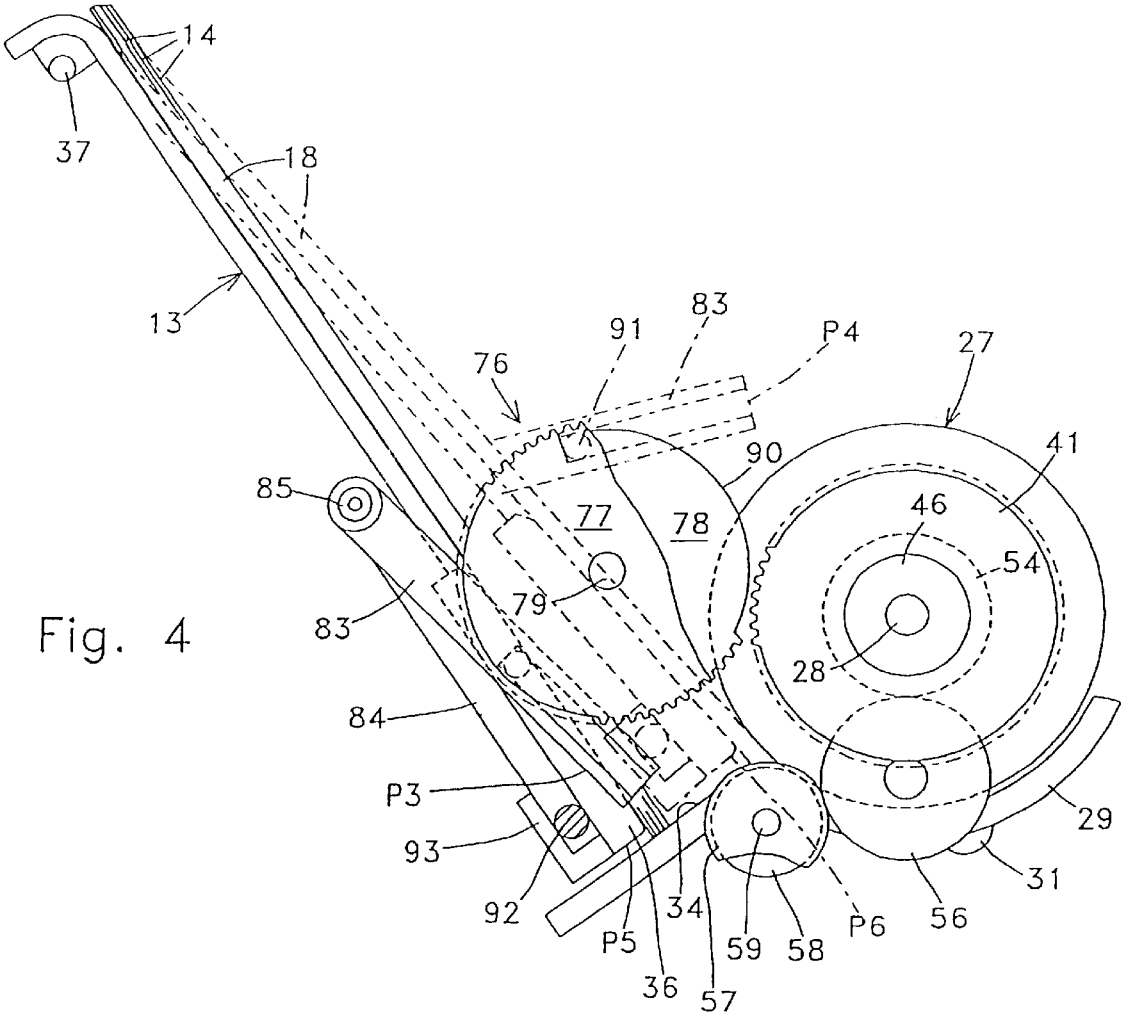
FIG. 4 is a partial view in vertical elevation of a part of the printer of FIG. 1, illustrating a mechanism for controlling a sheet feeding tray.

The gear train, intended to transmit rotational motion from the main motor 26 to the gear 41, has the further function of reducing the latter's angular velocity with respect to that of the motor 26 and comprises, as depicted in FIG. 2, a first gear 51 attached to a shaft of the main motor 26, a second gear 52 and a third gear 53. The main gear 41 is integral and coaxial with an internal gear 54 adapted to command, through a train of gears 56 and 57 (FIG. 4), the rotation of three counter-rotating rollers 58 mounted on a shaft 59 integral with the gear 57. The three counter-rotating rollers 58 are staggered with respect to the feeding members 27*a* and are called counter-rotating because, as will be seen better later, they rotate in the opposite direction to the feeding direction of the sheets 14 in order to prevent double sheet feeding from the feeding tray 13.

According to one characteristic of the printer 10 of the invention, the latter is provided with a control device, generically indicated with the numeral 40, suitable for selectively connecting or disconnecting the pairs of expulsion rollers 42*a*, 42*b* in the rotation with the main gear 41, so as to have the rollers 42*a* and 42*b* rotating synchronously with the feeding roller 27, or hold them motionless as the latter rotates, as will be illustrated more clearly below.

In particular, the control device 40 consists of a threaded member 61 (FIG. 3) provided with a helicoidal thread 61a and a toothed member 62 provided with a tooth 62*a* suitable for sliding along the thread 61*a* following a relative rotation between the members 61 and 62.

At the end of a relative rotation by a predetermined amount between the members 61 and 62, as better described below, the tooth 62*a* is adapted to come to rest against a shoulder 60 which marks the end of the thread 61*a*, so as to torsionally couple and make integral the members 61 and 62 in rotation, from that point on.

The threaded member 61 is rotatingly mounted on a pin 63 attached to the side 15*a* and is provided with a crown wheel 64 adapted to be rotated by the main gear 41 by means of two gears 66 and 67 freely pivoting about corresponding pins 68 and 69, also attached to the side 15*a*.

The toothed member 62 is in turn suitable for axially sliding along the pin 63 and is provided with external toothing 65 constantly meshing with a gear 72 attached to one end of the flexible shaft 43, so that the toothed member 62 is suitable to command the rotation of the pairs of expulsion rollers 42*a*, 42*b*.

In addition, the threaded member 61 and the toothed member 62 are constantly urged one against the other by a compression spring 71 arranged between the side 15*a* and the toothed member 62.

The threaded member 61 and the toothed member 62 are suitable for being screwed or unscrewed with respect to each other, so as to come closer together or move away from each other in relation to their direction of relative rotation. Furthermore the threading 62*a* is of such a size that the overall rotation that the members 61 and 62 perform, with respect to each other, first in one direction of rotation, then in another, from when they uncouple torsionally to when they recouple torsionally to become integral again in their rotation, corresponds exactly to a predetermined feeding distance travelled by the sheets 14 coming from the feeding tray 13, as will be better described below.

As already said, the drive mechanism 38 is intended to selectively move the wall 36 towards and away from the feeding roller 27, in order to produce feeding one at a time of the sheets 14 forming the ream 18 in the feeding tray 13.

In particular, the drive mechanism 38 comprises a rotating toothed group 76 (FIG. 5) suitable for being rotated by the main feeding gear 41, and a transmission group 82 provided for transmitting the rotation of the toothed group 76 to the movable wall 36 fulcrum-mounted on the pin 37, so as to selectively determine the drawing closer of the ream 18 to the roller 27.

In turn, the toothed group 76 comprises a first external gear 77 and a second internal gear 78, in which the gear 77 is fully provided with teeth around the outer edge whereas the gear 78 is only partially provided with teeth and its partial toothing is delimited by a toothless zone 90.

Furthermore the gears 77 and 78 are freely pivotable about a pin 79 attached to a wall 80 parallel with the side 15*a* and are connected together by a clutch, purpose of which is to permit, under certain conditions specified below, a relative rotation between the gears 77 and 78. In particular, the clutch comprises a member 81, of cork for instance, arranged between the two gears 77 and 78 and urged against the latter by a spring 75.

With regard to the transmission group 82, it comprises a first arm 83 fulcrum-mounted on the structure 11 by means of a pin 85, a second arm 84 also fulcrum-mounted on the fixed structure 11 by means of another pin 88, and a U-shape elastic wire 86, two end portions of which are integrally connected with the arms 83 and 84 and a central portion 87 suitable for twisting elastically to enable the latter to rotate with respect to each other.

The first arm 83 is adapted to be driven into rotation by the internal gear 78 and is provided, for this purpose, with a slot 89 intended for slidingly accommodating a peg 91 integral with the internal gear 78. In turn, the second arm 84 is suitable for commanding the rotation of the movable wall 26 and is provided, for this purpose, at the end with a peg 92, which is slidingly coupled with a guide 93 made in one end of the movable wall 36, opposite the one intended to accommodate the ream 18.

DESCRIPTION OF OPERATION OF THE INVENTION

The operation of the printer 10 described up to this point is as follows.

To start, it is assumed that a first sheet 14*a* (FIG. 1) taken from the ream 18 is already in engagement with the feeding roller 27. In this first stage, the main motor 26 turns in order to command a counter-clockwise rotation of the main gear 41, so that the shaft 28 and the main feeding roller 27 also rotate counter-clockwise, the gear 41 being integrally coupled with the shaft 28 through the monodirectional coupling 46.

In this way, the feeding roller 27, cooperating with the pressure wheels 31 and 32 and with the profile 29, conveys and feeds the sheet 14*a* towards and in front of the printhead 12, for it to be printed on.

Also, by way of the gears 66, 67 and the control device 40 which in this stage are in a condition in which the members 61 and 62 are integrally coupled together, the gear 41 commands, by rotating counter-clockwise, the counter-clockwise rotation of the motor rollers 42*a* of the expulsion group 25, so that the sheet 14*a*, as it is printed, is taken into charge by the pairs of rollers 42*a*, 42*b* which curve it so that it does not bend and, at the same time, feed it with a sliding action concurrent with that of the main roller 27.

When the sheet 14*a* has been fully printed on and has gone, with its bottom edge 20 (FIG. 1), slightly beyond the head 12, to a predetermined waiting position P1 in which the sheet 14*a* is fully disengaged from the roller 27 and is being held solely by the pairs of rollers 42*a*, 42*b*, the motor 26 stops, resulting in the sheet 14*a* also stopping.

At this point, the main motor 26 inverts its direction of rotation, so as to make the gear 41 rotate clockwise and for a predetermined angle, which gear 41 in turn causes a corresponding counter-clockwise rotation of the external gear 77 belonging to the toothed group 76 of the drive mechanism 38.

When the gear 41 starts to rotate clockwise, it uncouples torsionally, by way of the monodirectional coupling 46, from the shaft 28 and from the main feeding roller 27, which therefore remain perfectly motionless, also by virtue of the holding action exerted by the reverse gear member 47 on the shaft 28, in the position reached at the end of the counter-clockwise rotation of the gear 41.

At the time of the inversion of rotation of the motor 26, the toothed group 76 is in a position where the internal gear 78 is facing, with its toothless zone 90, onto the main feeding gear 41, so that the counter-clockwise rotation of the external gear 77, on account of the friction exerted by the member 81 placed between the gears 77 and 78, produces the integral rotation of the latter, in order to bring the toothed zone of the gear 78 into meshing arrangement with the gear 41. From this point, which also corresponds to the start of the stage in which the stress transmitted to the feeding tray 23 by the gear 78 is greatest, the latter-named is rotated directly by the gear 41 and in turn commands, by means of the peg 91 which slides in the slot 89, the counter-clockwise rotation of the arm 83 about the pin 85, bringing it into an upper position P4, indicated with the dot and dash line in FIG. 4, from a lower position P3 from where it started.

Shortly before the end of the predetermined rotation of the gear 41, the internal gear 78 once again presents the gear 41 its toothless zone 90, so that it unmeshes from the latter and in the final part of its rotation is driven by friction by the external gear 77 in constant meshing with the gear 41. This has no effect on correct positioning of the arm 83 in the position P4, as the unmeshing between the gear 41 and the gear 78 occurs when the arm 83 has practically reached the position P4 and the peg 91, with respect to the arm 83, is in a position where the stress it has to exert on the latter is minimum.

The counter-clockwise rotation of the first arm 83 from the position P3 to the position P4 is transmitted through the elastic wire 86 to the second arm 84, causing a corresponding rotation of the movable wall 36 from a starting position P5, in which the ream 18 is at a distance from the main feeding roller 27, to an end position P6, in which ream 18 is in contact with the roller 27, now motionless, with the sheet 14 arranged upwardly therein. The sheet is indicated with 14*b* and will be referred to in the following as the second sheet, since it is fed to the feeding roller 27 after the first sheet 14*a* referred to previously.

The rotation of the second arm 84 urging the movable wall 36 from below is of lesser amplitude than that of the first arm 83. In fact, the arm 84, much before the rotation of the arm 83 has been completed, stops as it has brought the ream 18 into contact with the roller 27, while on the other hand the first arm 83, urged by the peg 91, continues to rotate and produces a resulting torsion of the central portion 87 of the elastic wire 86. Accordingly the latter-named elastic wire accumulates elastic energy so as to produce a pressure between the second sheet 14*b* and the elements 27*a* of the feeding roller 27, of a value suitable to guarantee correct separation of the sheet 14*b* from the ream 18.

In the meantime, while the gear 41 is rotating clockwise to bring the ream 18 into engagement with the feeding roller 27, the same gear 41 commands, by way of the gears 66 and 67 and as is easily seen on observing FIG. 1, a counter-clockwise rotation of the crown wheel 64.

In this way, the threaded element 61 and the toothed element 62 of the control device 40 disengage torsionally by unscrewing, with respect to one another. In particular, the threaded element 61 integral with the crown wheel 64 turns counter-clockwise, i.e. in the direction of the arrow 95 of FIG. 3, whereas, on the other hand, the toothed element 62 continues to remain motionless in the angular position reached earlier as it is held in this position by the gear 72, in turn held by the reverse gear 50 acting on one end of the flexible shaft 43, so that in the final analysis the toothed element 62 is compelled by the counter-clockwise rotation of the threaded element 61 to slide axially to the right along the pin 63, in contrast with the action of the spring 71, thus coming closer to the side 15*a*.

It is clear therefore that, in this stage, the control device 40, by unmeshing torsionally in response to the inversion of the direction of rotation of the gear 41 from counter-clockwise to clockwise, acts so that that the sheet 14*a* remains motionless in the waiting position P1, stably held by the pairs of rollers 42*a*, 42*b*, for all the time in which the gear 41 turns clockwise to cause the engagement of the ream 18 with the main feeding roller 27.

At the end of the predetermined clockwise rotation of the main gear 41, the motor 26 again inverts its direction of rotation, so that the gear 41 starts turning counter-clockwise again, taking into rotation both the shaft 28 and the feeding roller 27 and, as a result, causing the feeding of the second sheet 14*b*, engaged with the latter, towards the printhead 12.

The counter-clockwise rotation of the gear 41 also produces the gradual withdrawal of the movable wall 36 from the position P6 of greatest proximity to the roller 27 to the starting position P5, thus enabling an unimpaired feeding of the second sheet 14*b* and arranging the ream 18 for a new sheet feeding cycle.

In particular, the counter-clockwise rotation of the gear 41 results in a corresponding clockwise rotation of the gear 77 which, in turn, drives the internal gear 78 by friction. In this way the gear 78 meshes again with the gear 41, so as to be rotated positively by the latter and cause, through the peg 91, the return movement of the arm 83 from the position P4 to the position P3. In this stage, the elastic wire 86 returns the elastic energy previously accumulated, thus assisting the return of the movable wall 36 to the starting position P5.

Both when the ream 18 is being brought closer to the roller 27 and subsequently when it is removed therefrom, the clutching element 18 may intervene to enable small rotations among the gears 77 and 78 of the toothed group 76, corresponding to overtravel rotations that the gear 77, in constant meshing with the gear, may make after the movable wall 36 has already reached the positions P5 or P6. It will be clear that the purpose of these overtravel rotations is to ensure the positioning of the movable wall 36 in the position P6 and P5, respectively at the end of each stage of approach and removal of the latter from the roller 27.

While the main feeding roller 27 is rotating counter-clockwise to feed the second sheet 14*b*, the gear 41 commands, through the gears 54, 56 and 57, the counter-clockwise rotation of the shaft 59 and of the counter-rotating rollers 58 affixed thereto. In this way, the rollers 58 rotate on the surface of the second sheet 14*b* not in contact with the feeding roller 27 according to a direction opposite the feeding direction of the sheet 14*b*, in order to prevent the latter from dragging another sheet with it, so giving rise to the problem known as double sheet feeding. Naturally the rotation of the rollers 58 contrary to the feeding direction of the sheets 14 cannot interfere with or disturb in any way their being fed, as the force that the counter-rotating rollers 58 are capable of applying on the sheets 14 for preventing the double sheet feeding problem, is considerably less than that applied by the feeding elements 27*a* and by the pressure wheels 31 and 32 on the sheets 14 for feeding them.

Figure 3:
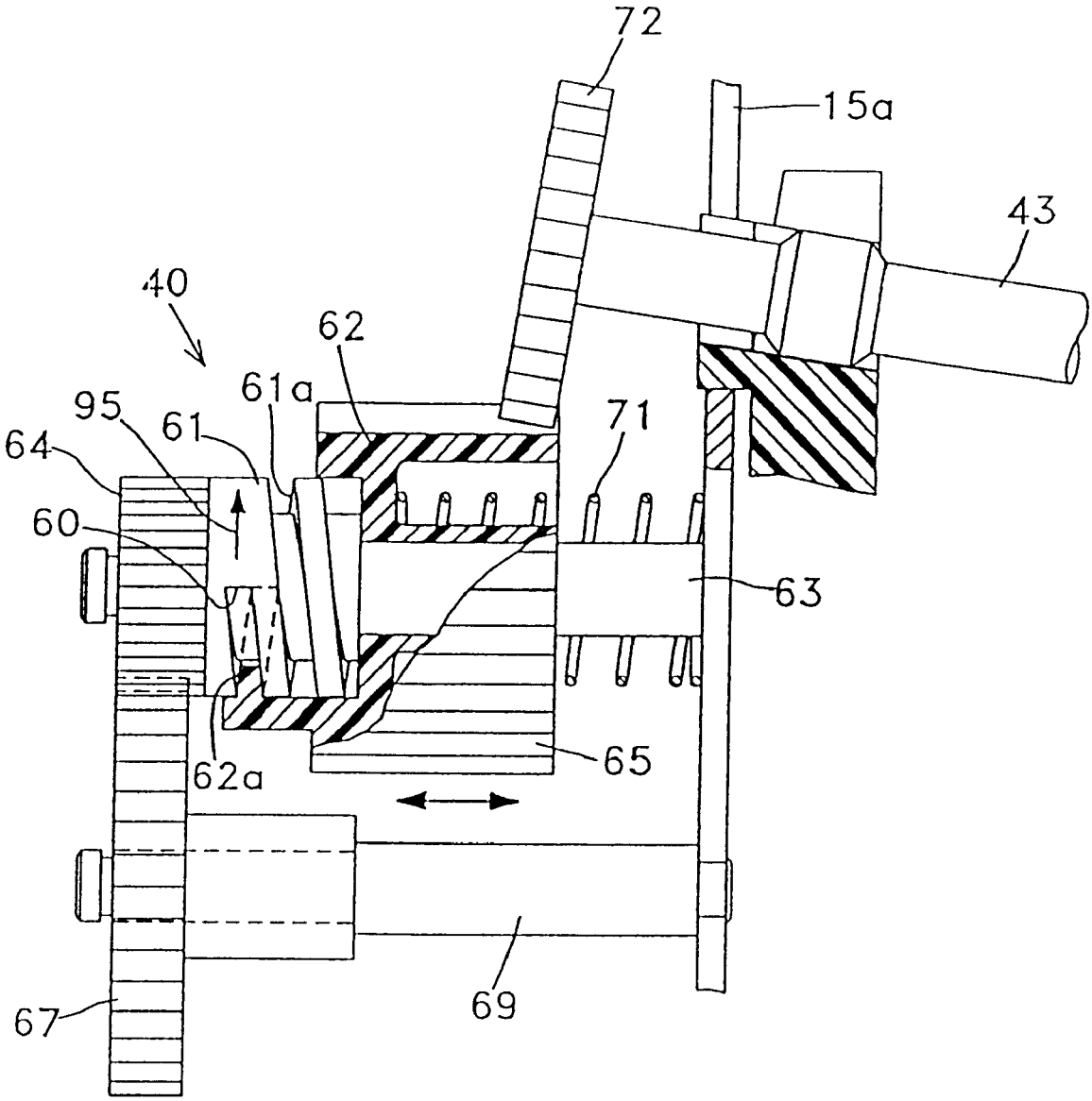
FIG. 3 is a partial cross-sectional view of some details of FIG. 2, illustrating a device for delaying the stacking of the printed sheets.

Furthermore the inversion of the direction of rotation of the gear 41 from clockwise to counter-clockwise produces a corresponding inversion of rotation of the crown wheel 64 and therefore of the threaded element 61 which thus starts rotating clockwise, i.e. according to a direction opposite to that of the arrow 95 (FIG. 3). This results in the two elements 61 and 62 gradually screwing together, with in particular the toothed element 62 axially sliding to the left and along the pin 63, so that the tooth 62*a* gradually approaches the shoulder 60.

At a certain point, while the gear 41 continues to rotate counter-clockwise, the tooth 62*a* reaches and comes to rest against the shoulder 60, which constitutes the bottom of the thread of the element 61, and in this way again causes the torsional meshing of the threaded element 61 and the toothed element 62, so that from this time on the two elements 61 and 62 rotate integrally, thus determining the rotation of the gear 72 and of the various pairs of expulsion rollers 42*a*, 42*b*.

In particular, the point when the tooth 62*a* reaches the shoulder 60 and comes to rest against it corresponds to a position P2 of the second sheet 14*b*, represented by the dot and dash line in FIG. 1, and in which the second sheet 14*b* is disposed with a leading edge 30 at a predetermined minimum distance D (FIG. 1) from the trailing edge 20 of the first sheet 14*a* which, it will be recalled, is still motionless in the position P2 as it is held by the pairs of expulsion rollers 42*a*, 42*b*.

Subsequently the first sheet 14*a* and the second sheet 14*b* move forward together, keeping at the minimum distance D, while the gear 41 continues to rotate counter-clockwise, so that the first sheet 14*a* at a certain point goes beyond the pairs of expulsion rollers 42*a*, 42*b* and falls into the collection tray 16 where it is stacked on another previously printed sheet already deposited in the collection tray 16, and the second sheet 14*b* moves in front of the printhead 12 to be printed on by the latter.

It is clear therefore from what has been described that the first sheet 14*a* remains motionless in the position P1, held by the pairs of expulsion rollers 42*a*, 42*b*, during the relative rotation, first in one direction and then in the opposite direction, between the elements 61 and 62 and that this rotation corresponds to the distance travelled forward by the second sheet 14*b* until it is at the predetermined minimum distance D from the first sheet 14*a*.

It is equally clear that the ink jet printer 10 withholds the first sheet 14*a* and delays expulsion thereof to the collection tray 16 and the subsequent stacking on a sheet printed previously and already deposited in the latter, until when the second sheet 14*b* has come to the minimum distance D from the first sheet 14*a*, so that the time elapsing from when a generic sheet is printed on to when a subsequent sheet is stacked upon it is considerably longer than the time that would pass if the sheets were expelled into the collection tray 16 immediately after printing.

In this way, the ink deposited on each sheet has more time to dry before the sheet is stacked on the previously printed sheets in a storing zone, and this considerably lowers the likelihood of the stacking in the storing zone causing an alteration of the quality of the characters and/or symbols printed on the sheets, on account of the ink not being fully dry.

It is understood that various changes and/or improvements may be made to the ink jet printer suitable for delaying the stacking of the printed sheets, corresponding to the preferred embodiment described above, without exiting from the scope of the invention.

What I claim is:

1. Printer for the printing of single sheets, comprising an ink jet printhead;

feeding means for feeding said sheets one at a time through a printing zone in which they are printed on by said printhead and then to a collection tray; and control means, associated with said feeding means, for temporarily stopping the feeding of an already printed first sheet to said collection tray, and for reactivating said feeding to said collection tray only after said feeding means have fed a second sheet to bring it to a predetermined minimum distance from said first sheet.

2. Printer for the printing of single sheets, comprising an ink jet printhead for printing on said sheets;

feeding means for feeding said sheets one at a time to said printhead to be printed on;

a collection tray for receiving said sheets after they have been printed on;

expulsion means for receiving said sheets from said feeding means and expelling them to said collection tray; and control means for cooperating with said feeding means and said expulsion means for feeding, during a first stage, a first sheet so that it reaches and stops at a predetermined waiting position after it has been printed on for feeding, during a second stage following said first stage, a second sheet to said printhead until it has come to a predetermined minimum distance from said first sheet, while said first sheet is motionless in said predetermined waiting position; and finally for feeding together, during a third stage following said second stage, said first and second sheet so that said first sheet is expelled into said collection tray and said second sheet is printed on, whereby the expulsion and stacking of said first sheet with the sheets already printed and deposited in said collection tray is delayed and effected only after said second sheet has come to said predetermined distance from said first sheet.

3. Printer according to claim 2, wherein said control means are provided for commanding the stopping of said first sheet in said predetermined waiting position, when said first sheet is no longer held by said feeding means, but is held solely by said expulsion means.

4. Printer according to claim 3, wherein said feeding means comprise at least one feeding roller for rotating in contact with said first sheet and said second sheet;

said expulsion means comprise at least one expulsion roller for rotating in contact with said first and said second sheet; and said control means comprise a device for selectively and mechanically connecting or disconnecting in rotation said expulsion roller and said feeding roller.

5. Printer according to claim 4, wherein said device is adapted for connecting in rotation said feeding rollers and said expulsion rollers during said first stage and for disconnecting them, at the end of said first stage, when said second sheet reaches said predetermined minimum distance from said first sheet; wherein said device is adapted, during said second stage following said first stage, for keeping said expulsion roller disconnected from said feeding roller; and wherein said device is finally adapted, at the end of said second stage, for again mechanically connecting them in rotation.

6. Printer according to claim 4 or 5, further comprising a main motor for driving the rotation of said feeding roller and of said expulsion roller, wherein said device consists of a group comprising a threaded element and a toothed element provided for rotating relatively together in such a way as to be coupled or uncoupled by torsion, one of said elements being constantly connected to said expulsion roller and the other element being constantly connected to said motor.

7. Printer according to claim 6, wherein, during said first stage, said elements are torsionally coupled together and furthermore said motor rotates in a first direction of rotation so as to feed, by means of said feeding roller, said first sheet to said predetermined waiting position, whereby said expulsion roller and said feeding roller rotate synchronously;

wherein, during said second stage, said motor rotates first in a direction opposite to said first direction of rotation and then rotates according to said first direction of rotation so as to feed, by means of said feeding roller, said second sheet to said predetermined minimum distance from said first sheet, so that said elements first rotate relatively in such a way as to be uncoupled by torsion and thus to disconnect said expulsion roller from said motor and accordingly stop the rotation of said expulsion roller, and then said elements invert their relative rotation so as to become coupled again by torsion at the end of said second stage, so that said expulsion roller is connected again to said motor; and wherein, during said third stage, said motor continues to rotate according to said first direction of rotation, so that said expulsion roller and said feeding roller rotate synchronously to simultaneously feed both said first sheet and said second sheet;

whereby both the duration of said second stage, during which said expulsion roller remains motionless, and the predetermined minimum distance, between said first sheet and said second sheet, correspond to the relative rotation first in one direction and then in the other opposite direction that the two elements effect between two successive reciprocal torsional couplings.

8. Printer according to claim 7, wherein said threaded element is provided with a thread having at one end a shoulder and said toothed element is provided with a tooth for coming to rest against said shoulder at the end of the relative rotation between said elements, so as to result in the torsional coupling therebetween.

9. Printer according to claim 7, further comprising a main drive gear constantly connected to said motor for rotating permanently in synchrony therewith, and a monodirectional coupling adapted to monodirectionally connect said main drive gear to said feeding roller, whereby said feeding roller rotates together with said motor, when the latter rotates according to said first direction of rotation, and conversely remains motionless, when said motor rotates according to said opposite direction of rotation.

10. Printer according to claim 9, further comprising a feeding tray for containing a plurality of said sheets, and a drive mechanism adapted to selectively bring said feeding tray close to or away from said feeding roller causing one sheet to be picked and fed at a time from said feeding tray, said drive mechanism comprising:

a rotating toothed group provided for being driven by said main drive gear, and a transmission group for transmitting the motion from said toothed group to said feeding tray causing, in relation to the rotation of said toothed group, said feeding tray to be brought close to or away from said feeding roller;

wherein, during said second stage, said toothed group, in response to the rotation of said motor first according to said opposite direction of rotation and then according to said first direction of rotation, first rotates so as to bring, through said transmission group, said feeding tray clean in said feeding roller, and then rotates in the inverse direction to before so as to bring said feeding tray away from said feeding roller.

11. Printer according to claim 10, wherein said rotating toothed group consists of a first and a second coaxial gear placed side by side, of which the first gear is constantly meshing with said main drive gear and the second gear is provided along the outer edge with a toothless zone, and of a clutch element which connects said first and said second gear together by friction thus permitting reciprocal rotation;

wherein said transmission group consists of a first and a second arm and of an elastic element connecting said first and said second arm, said first arm being adapted to be driven by said second gear, said second arm being adapted to cooperate with said feeding tray for commanding it to be brought close to or away from said feeding roller, and said elastic element becoming elastically deformed, during the approach movement of said feeding tray, in order to generate a pressure of a predetermined value between the sheets contained in said feeding tray and said feeding roller, and returning the elastic energy thus stored, during the removal movement of said feeding tray;

wherein said second gear is provided for presenting said toothless zone to said main drive gear at the beginning and at the end of said second stage, so that said first gear, simultaneously with the rotation of said motor according to said opposite direction of rotation, through said clutch element, brings said second gear into rotation until when the latter meshes with said main drive gear and the subsequent rotation of said second gear, causing the deformation of said elastic element, is driven directly by said main drive gear.

12. Printer for the printing of single sheets, comprising an ink jet printhead, feeding means for feeding in succession a first sheet and a second sheet from a storing zone of said sheets to a printing zone in front of said printhead for them to be printed on, and a collection tray for receiving said first sheet and said second sheet coming from said printing zone, said feeding means comprising first feeding means and second feeding means arranged respectively at opposite ends with respect to said printing zone and provided for selectively feeding said first sheet and said second sheet;

wherein said first feeding means and said second feeding means are provided, during a first stage, for feeding said first sheet until it reaches and stops at a waiting position after it has been printed on;

wherein said first feeding means are provided, during a second stage following said first stage, for feeding said second sheet towards said printhead to a predetermined minimum distance from said first sheet, while the latter is motionless in said waiting position; and wherein said first and second feeding means are provided, during a third stage following said second stage after said second sheet has reached said predetermined minimum distance, for simultaneously feeding said first sheet and said second sheet so that said first sheet is expelled into said collection tray and for further feeding said second sheet so that it is printed on.

13. Device for delaying the stacking of the sheets printed in a printer provided with an ink jet printhead and with feeding means for feeding said sheets one at a time through a printing zone, in which they are printed on by said printhead, and subsequently towards a collection tray, said device comprising control means of said feeding means for temporarily stopping the feeding of a first already printed sheet towards said collection tray, and for reactivating said feeding towards said collection tray only after said feeding means have fed a second sheet to bring it to a predetermined minimum distance from said first sheet.

14. Device for delaying the printing of the sheets printed in a printer of the type having:

an ink jet printhead for printing in succession a first and a second sheet;

a feeding tray;

at least one feeding roller for picking said first sheet and second sheet from said feeding tray and feeding them in front of said printhead to be printed on;

a collection tray; and at least one expulsion roller for expelling said first sheet and said second sheet into said collection tray after they have been printed on;

wherein said device is arranged for selectively and mechanically connecting in rotation said expulsion roller and said feeding roller during a first stage, so that said feeding and expulsion rollers, by rotating synchronously, feed said first sheet in front of said printhead and bring it, at the end of said first stage, to a predetermined waiting position, wherein said first sheet is no longer held by said feeding roller but is still held by said expulsion roller;

wherein said device is also arranged for selectively and mechanically disconnecting said expulsion roller from said feeding roller, during a second stage following said first stage, so that said feeding roller, by rotating, feeds said second sheet towards said printhead bringing it to a predetermined minimum distance from said first sheet, while the latter is held motionless by said expulsion roller; and wherein, at the end of said second stage, said device is finally arranged for again mechanically connecting said expulsion roller and said feeding roller so that, by rotating synchronously, they respectively cause the expulsion of said first sheet into said collection tray and a further feeding of said second sheet;

whereby the stacking of said first sheet with the sheets already printed and deposited in said collection tray is delayed and effected only after said second sheet has come to said predetermined minimum distance from said first sheet.

15. Device according to claim 14, wherein said printer further comprises a single motor for driving both said feeding roller and said expulsion roller, said device being provided with a group consisting of a threaded element and a toothed element capable of sliding axially one with respect to the other by rotating reciprocally, one of which is connected to said feeding roller while the other is connected to said expulsion roller;

said elements for integrally coupling so as to mechanically connect said expulsion roller to said feeding roller, in response to a rotation of said motor in a first direction of rotation; and said elements for uncoupling and rotating idly with respect to each other so as to mechanically disconnect said expulsion roller from said feeding roller, in response to a rotation of said motor in an opposite direction of rotation to said first direction of rotation.

16. Method for the feeding of sheets in an ink jet printer, said printer having a path for said sheets, a printhead arranged along said path for effecting a printing operation on said sheets, and a collection tray for receiving said sheets after said printing operation, said method comprising the following steps:

feeding a first sheet of said sheets along said path, feeding it under said printhead for effecting said printing operation and temporarily stopping it before expelling it into said collection tray;

feeding a second sheet of said sheets along said path and feeding it until it comes to a predetermined minimum distance from said first sheet; and simultaneously feeding, after said predetermined minimum distance has been reached by said second sheet, said first sheet and said second sheet, so that said first sheet is expelled into said collection tray and said printing operation is effected on said second sheet.

17. Method for delaying the stacking of the single sheets printed in a printer comprising an ink jet printhead arranged to print one after the other said sheets and a collection tray for accommodating said sheets after they have been printed on, said method comprising the following steps:

feeding a first sheet and temporarily stopping the feeding thereof when it reaches a waiting position after it has been printed on and before it is expelled into said collection tray;

subsequently feeding a second sheet towards said printhead until it comes to a predetermined minimum distance from said first sheet, while the latter is motionless in said waiting position and finally, simultaneously feeding said first sheet and said second sheet so that said first sheet is expelled into said collection tray and said second sheet is printed on, so that the expulsion and the stacking of said first sheet with the sheets already printed on and deposited in said collection tray is delayed and effected only after said second sheet has come to said predetermined minimum distance from said first sheet.

* * * * *

UNITED STATES PATENT AND TRADEMARK OFFICE

CERTIFICATE OF CORRECTION

PATENT NO. : 5,980,141
DATED : November 9, 1999
INVENTOR(S) : Gian Paolo Donnis

It is certified that error appears in the above-identified patent and that said Letters Patent is hereby corrected as shown below:

On the title page, item [75], delete "Israel" and insert --Italy--.
On the title page, item [30], delete "Israel" and insert --Italy--.

Signed and Sealed this

Thirteenth Day of June, 2000

*Attest:*

Q. TODD DICKINSON

*Attesting Officer*

*Director of Patents and Trademarks*